US006361159B1

(12) United States Patent
Chino

(10) Patent No.: US 6,361,159 B1
(45) Date of Patent: Mar. 26, 2002

(54) PRINTING DEVICE HAVING PRESSURE FLUCTUATION ACCOMMODATING STRUCTURE

(75) Inventor: Masahiko Chino, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/388,283

(22) Filed: Sep. 1, 1999

(30) Foreign Application Priority Data

Sep. 1, 1998 (JP) ..... 10-247342
Sep. 24, 1998 (JP) ..... 10-270286

(51) Int. Cl.[7] ..... B41J 2/175
(52) U.S. Cl. ..... 347/86
(58) Field of Search ..... 347/86, 92

(56) References Cited

U.S. PATENT DOCUMENTS 5,363,130 A * 11/1994 Cowger et al. ..... 347/92
5,500,663 A * 3/1996 Ujita et al. ..... 347/86
5,646,664 A * 7/1997 Pawlowski, Jr. ..... 347/86
5,784,088 A * 7/1998 Ujita et al. ..... 347/86
5,992,988 A * 11/1999 Haigo ..... 347/86
6,039,441 A * 3/2000 Tomikawa et al. ..... 347/86

* cited by examiner

*Primary Examiner*—David F. Yockey
(74) *Attorney, Agent, or Firm*—Hogan & Hartson, L.L.P.

(57) ABSTRACT

A print head device has a seal packing and pressure fluctuation-accommodating structure. The seal packing is arranged such that when an ink cartridge storing ink therein and having an ink delivery port for delivering the ink therefrom is mounted in the print head, the seal packing is brought into airtight contact with the ink cartridge such that the seal packing encloses the ink delivery port, thereby defining an inner space within the seal packing, for airtight communication between the ink delivery port and the inner space. The pressure fluctuation-accommodating structure accommodates pressure fluctuations within the ink delivery port and the inner space in communication with each other. Alternatively, the ink cartridge includes the pressure fluctuation-accommodating structure. An ink jet printer includes the print head device.

4 Claims, 12 Drawing Sheets

FIG. 12A
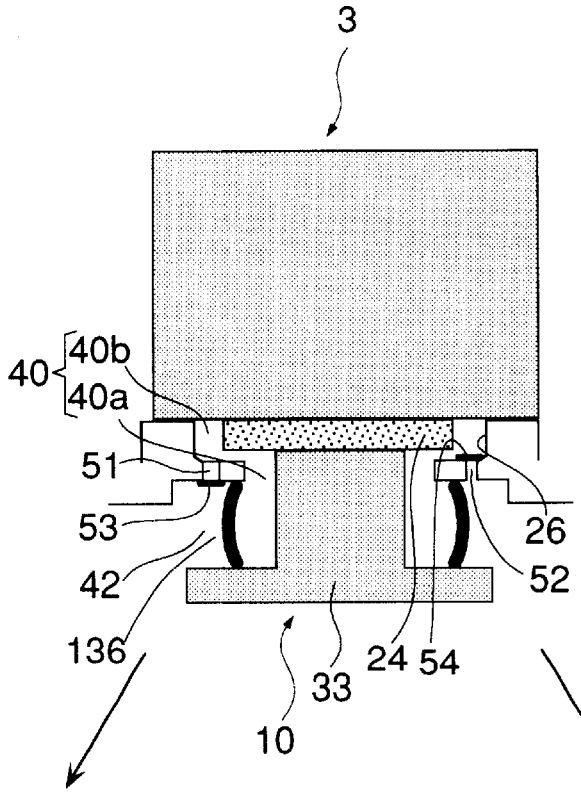
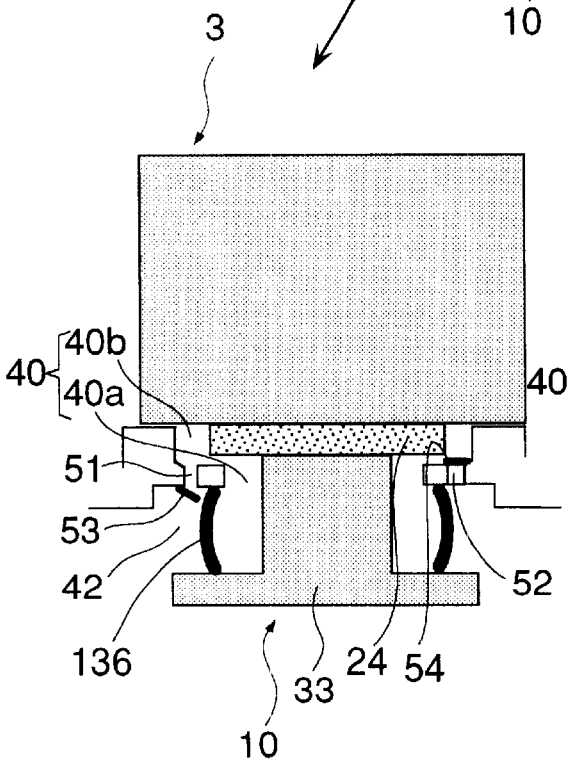
FIG. 12B
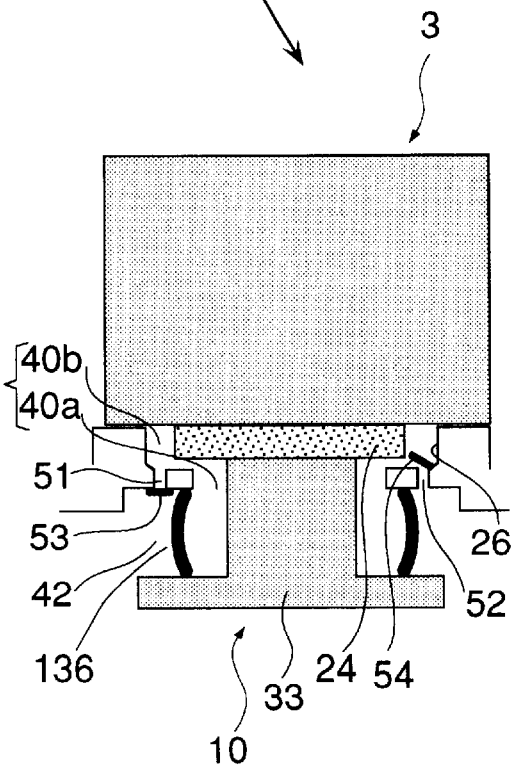
FIG. 12C

PRINTING DEVICE HAVING PRESSURE FLUCTUATION ACCOMMODATING STRUCTURE

BACKGROUND OF THE INVENTION

1. Field of the Invention

This invention relates to a print head device for use in combination with an ink cartridge mounted therein, and an ink jet printer incorporating the print head device, and the ink cartridge.

2. Prior Art

Ink jet printers have the inconvenience that an ink meniscus at nozzle tips of a print head thereof is destroyed even by a slight shock or impact (for instance, one caused by a fall of the ink jet printer from a position one or two centimeters high). The destruction of meniscus causes "thinned nozzles" which means a faulty ink-discharging action of nozzles or "angled jets" which means undesirably angled jets of ink drops, resulting in a faulty printing operation. Especially, in the case of ink jet printers of a type which has ink delivery ports of an ink cartridge connected to connecting caps of a head unit thereof in surface-to-surface contact, more particularly, a type which has seal packings interposed between the connecting caps and the ink delivery ports, respectively, the seal packings are contracted and expanded by a shock to cause pressure fluctuations within closed spaces inside the seal packings. The pressure fluctuations can propagate to ink, resulting in destruction of the ink meniscus at nozzle tips.

Users of ink jet printers which are generally commercially available are advised to carry out cleaning of a print head of their printer by manually instructing the cleaning operation thereto even when it is simply moved e.g. for a change of position where it is placed, since there is a fear that the ink meniscus at nozzle tips thereof is destroyed.

Therefore, in the case of ink jet printers of a portable type or ones which have to be frequently carried from one place to another, automatic or manual cleaning of a print head thereof is very frequently required. Such ink jet printers wastefully consume a large amount of ink, which degrades commercial value thereof.

SUMMARY OF THE INVENTION

It is an object of the invention to provide a print head device, an ink jet printer incorporating the print head device, and an ink cartridge, which are capable of preventing an ink meniscus at nozzle tips of the print head device from being destroyed by a shock or impact applied to the ink jet printer.

To attain the above object, according to a first aspect of the invention, there is provided a print head device in which an ink cartridge storing ink therein and having an ink delivery port for delivering the ink therefrom is removably mounted for use therewith, the print head device comprising:

a seal packing arranged such that the seal packing is brought into airtight contact with the ink cartridge when the ink cartridge is mounted in the print head device, such that the seal packing encloses the ink delivery port, thereby defining an inner space within the seal packing, for airtight communication between the ink delivery port and the inner space; and pressure fluctuation-accommodating means for accommodating pressure fluctuations within the ink delivery port and the inner space in communication with each other.

According to this print head device, when the print head device having the ink cartridge mounted therein receives a shock or impact, inertia of the ink cartridge causes expansion and contraction or compression of the seal packing, whereby the volume of the inner space inside the seal packing is fluctuated, causing pressure fluctuations within the ink delivery port and the inner space in communication with each other. However, the pressure fluctuations are accommodated by the pressure fluctuation-accommodating means. This prevents the pressure fluctuations from propagating to ink, and thereby inhibits pulsation of the ink. Thus, the print head device according to the first aspect of the invention can suitably accommodate pressure fluctuations within the ink delivery port and the inner space in communication with each other, thereby effectively preventing destruction of an ink meniscus at tips of ink nozzles. This enhances shock resistance of the print head device.

Preferably, the pressure fluctuation-accommodating means comprises an air communication passage, the air communication passage having one end open to the inner space within the seal packing and another end open to the atmosphere.

According to this preferred embodiment, the pressure fluctuations within the ink delivery port and the inner space in communication with each other are accommodated by air flows in the air communication passage.

More preferably, the print head device includes a cartridge-receiving portion for receiving the ink cartridge thereat, and the air communication passage comprises a groove formed in a surface of the cartridge-receiving portion, and a film hermetically covering the groove except for opposite ends thereof.

According to this preferred embodiment, the air communication passages can be easily formed by forming a groove in advance in the surface of the cartridge-receiving portion, and affixing a film over the groove by thermocompression bonding. Further, the air communication passages formed do not produce unacceptably concave or convex portions on the surface of the cartridge-receiving portion.

Preferably, the air communication passage extends in a meandering manner.

According to this preferred embodiment, it is possible to minimize evaporation of a solvent, such as water or the like, contained in ink.

More preferably, a drop of non-volatile sealing liquid is sealingly held in the air communication passage, for motion in accordance with air flows in the air communication passage.

According to this preferred embodiment, it is possible to prevent evaporation of a solvent contained in ink. The provision of non-volatile sealing liquid in the air communication passage is useful especially when an ink diluted by a highly volatile solvent is employed.

Alternatively, the pressure fluctuation-accommodating means comprises a pouch formed of a flexible membrane arranged in an outer space outside the seal packing, the outer space being in communication with the atmosphere, and a communication passage permitting airtight communication between the pouch and the inner space.

According to this preferred embodiment, when the print head device having the ink cartridge mounted therein receives a shock to cause expansion and contraction or compression of the seal packing, pressure in the inner space inside the seal packing is fluctuated. However, the pressure fluctuations are accommodated by air flows to and from the pouch which is formed of a flexible membrane and in communication with the inner space via the communication passage. This prevents fluctuations in the volume of the inner space inside the seal packing from developing a large pulsation of ink supplied from the ink delivery port to the ink nozzles of the print head device. Further, it is possible to positively prevent evaporation of a solvent, such as water or the like, contained in ink.

Preferably, the communication passage extends through the seal packing.

Alternatively, the ink cartridge further includes a casing, an absorbent filled in the casing, for absorbing the ink for storage, and a filter arranged between the absorbent and the ink delivery port;

the print head device further comprising a connecting portion for being inserted into the ink delivery port when the ink cartridge is mounted in the print head device such that the connecting portion pushes the filter inward, for permitting the ink delivered from the ink delivery port to flow therethrough;

the seal packing comprising a wall forming a generally hollow cylindrical shape and constructed such that the wall is bent inward when an external force is applied to the seal packing in a compressing direction, whereby the seal packing doubles as the pressure fluctuation-accommodating means.

According to this preferred embodiment, when the print head device having the ink cartridge mounted therein receives a shock to cause relative motion of the ink cartridge toward the print head device, the connecting portion of the print head device pushes inward the filter of the ink cartridge by a distance of the motion, and at the same time the seal packing is contracted. In this process, the seal packing is bent inward to reduce the volume of the inner space, whereby a positive pressure is generated in the inner space, while the volume of evacuated space which is produced by the insertion of the connecting portion of the print head device and in communication with the ink delivery port is increased whereby a negative pressure is generated in the evacuated space. This causes air to flow from the inner space inside the seal packing to the evacuated space to accommodate changes in pressure generated in the inner space and the evacuated space such that the positive and negative pressures cancel each other. Inversely, when the ink cartridge is moved away from the print head device, the motion acts to permit the filter to push out the connecting portion by a distance of the motion, and at the same time the seal packing to be extended. Extension of the seal packing increases the volume of the inner space to generate a negative pressure within the inner space, while the volume of the evacuated space is reduced to generate a positive pressure therein. This causes air to flow from the evacuated space to the inner space inside the seal packing to accommodate changes in pressure such that the negative and positive pressures cancel each other. It should be noted that the cross-sectional shape of the wall forming the generally hollow cylindrical shape is not limited to a circular arc, but the wall may have any cross-sectional shape, such as a segment of ellipse, so long as it is bent arcuately inward. As described above, according to the preferred embodiment, changes in pressure or pressure fluctuations in the inner space and the evacuated space can be accommodated such that they cancel each other. Hence, it is possible to effectively prevent destruction of an ink meniscus at the nozzle tips, thereby enhancing shock resistance of the print head device by the above-described construction, which is simple.

Preferably, the seal packing is generally slightly bent inward when the seal packing is in a free state.

According to this preferred embodiment, the seal packing can be naturally bent inward when the external force is applied thereto in the compressing direction.

Preferably, the seal packing has an inner diameter substantially equal to an outer diameter of the filter.

According to this preferred embodiment, the amount of a change in volume of the inner space inside the seal packing caused by the relative motion of the ink cartridge toward or away from the print head device is substantially equal to that in the evacuated space simultaneously caused by the relative motion, so that it is possible to minimize the change in the internal pressure inside the seal packing and the ink cartridge.

To attain the above object, according to a second aspect of the invention, there is provided an ink cartridge which stores ink therein, and is removably mounted in a print head device for use therewith, the print head device having a seal packing arranged such that the seal packing is brought into airtight contact with the ink cartridge to define an inner space within the seal packing when the ink cartridge is mounted in the print head device, the ink cartridge comprising:

a cartridge casing for being brought into airtight contact with the seal packing;

an ink delivery port formed through the cartridge casing, for delivering the ink therefrom, the ink delivery port being arranged such that the ink delivery port establishes airtight communication with the inner space defined within the seal packing when the ink cartridge is mounted in the print head device; and pressure fluctuation-accommodating means for accommodating pressure fluctuations within the ink delivery port and the inner space in communication with each other.

According to this ink cartridge, when the print head device having the ink cartridge mounted therein receives a shock or impact, inertia of the ink cartridge causes expansion and contraction or compression of the seal packing, whereby the volume of the inner space inside the seal packing is fluctuated, causing pressure fluctuations within the ink delivery port and the inner space in communication with each other. However, the pressure fluctuations are accommodated by the pressure fluctuation-accommodating means. This prevents the pressure fluctuations from propagating to ink, and thereby inhibits pulsation of the ink. Thus, the ink cartridge according to the second aspect of the invention can suitably accommodate pressure fluctuations within the ink delivery port and the inner space in communication with each other, thereby effectively preventing destruction of an ink meniscus at tips of ink nozzles. This enhances shock resistance of the ink cartridge.

Preferably, the pressure fluctuation-accommodating means comprises an air communication passage formed in a surface of the cartridge casing, the air communication passage having one end open to the inner space within the seal packing and another end open to the atmosphere.

According to this preferred embodiment, the pressure fluctuations within the ink delivery port and the inner space in communication with each other are accommodated by air flows in the air communication passage.

More preferably, the air communication passage comprises a groove formed in the surface of the cartridge casing, and a film hermetically covering the groove except for opposite ends thereof.

According to this preferred embodiment, the air communication passages can be easily formed by forming a groove in advance in the surface of the cartridge casing, and affixing a film over the groove by thermocompression bonding. Further, the air communication passages formed do not produce unacceptably concave or convex portions on the surface of the cartridge casing where the sealing packing is brought into airtight contact.

Preferably, the air communication passage extends in a meandering manner.

According to this preferred embodiment, it is possible to minimize evaporation of a solvent, such as water or the like, contained in ink.

Preferably, a drop of non-volatile sealing liquid is sealingly held in the air communication passage, for motion in accordance with air flows in the air communication passage.

According to this preferred embodiment, it is possible to prevent evaporation of a solvent contained in ink. The provision of non-volatile sealing liquid in the air communication passage is useful especially when an ink diluted by a highly volatile solvent is employed.

Alternatively, the print head device further includes a connecting portion for being inserted into the ink delivery port when the ink cartridge is mounted in the print head device, for permitting the ink delivered from the ink delivery port to flow therethrough;

the ink cartridge further comprising an absorbent filled in the cartridge casing, for absorbing the ink for storage, and a filter arranged between the absorbent and the ink delivery port, for being pushed inward when the ink cartridge is mounted in the print head device;

the cartridge casing having a delivery port rim portion defining the ink delivery port therein and being brought into airtight contact with the seal packing, the delivery port rim portion being formed with a filter-receiving portion for receiving the filter therein; and the pressure fluctuation-accommodating means comprises an air communication passage formed through the delivery port rim portion, for communication between an inside of the filter-receiving portion and an outer space outside the seal packing, and valve means arranged for the air communication passage for opening inward and outward according to the pressure fluctuations.

According to this ink cartridge, when the print head device having the ink cartridge mounted therein receives a shock to cause relative motion of the ink cartridge toward and away from the print head device, the seal packing is compressed and expanded. If the compression or expansion of the seal packing generates a positive pressure within the inner space and an evacuated space which is produced by the insertion of the connecting portion of the print head device and in communication with the ink delivery port, the valve means opens outward to permit air to flow out via the air communication passage, while if a negative pressure is generated in the same, the valve means opens inward to permit air to flow in via the air communication passage. As a result, the changes in pressure or pressure fluctuations within the inner space and the evacuated space caused by changes in volume of these spaces are accommodated by air flows through the air communication passage opened and closed by the valve means.

More preferably, the air communication passage includes a first passage, and a second passage, the valve means including a positive pressure valve element arranged for the first passage, for opening outward when a positive pressure is generated within the ink delivery port and the inner space in communication with each other, and a negative pressure valve element arranged for the second passage, for opening inward when a negative pressure is generated within the ink delivery port and the inner space in communication with each other.

According to this preferred embodiment, the valve means and a valve sheet brought into intimate contact with the valve means can be configured to have a simple construction such that the valve means is accurately opened and closed.

To attain the above object, according to a third aspect of the invention, there is provided an ink jet printer for use in combination with an ink cartridge storing ink and having an ink delivery port for delivering ink therefrom, the ink jet printer comprising the print head device according to the first aspect of the invention described above.

This ink jet printer is advantageous in that it is excellent in shock-resistance and suitable for a portable use.

The above and other objects, features, and advantages of the invention will become more apparent from the following detailed description taken in conjunction with the accompanying drawings.

BRIEF DESCRIPTION OF THE DRAWINGS

FIG. 12A is a schematic cross-sectional view of an ink cartridge mounted in a print head unit, according to a sixth embodiment of the invention, in a normal state thereof;

FIG. 12B is a schematic cross-sectional view of the FIG. 12A ink cartridge and print head unit, with a valve element thereof opened outward; and FIG. 12C is a schematic cross-sectional view of the FIG. 12A ink cartridge and print head unit, with a valve element thereof opened inward.

DETAILED DESCRIPTION

The invention will now be described in detail with reference to the drawings showing embodiments thereof. In these embodiments, a print head device and an ink jet printer according to the invention are applied to a tape printing apparatus. The tape printing apparatus is capable of carrying out color printing of desired characters and the like entered by keyboard on a tape as a print material, by an ink jet printing method, and cutting off the printed portion or strip of the tape to thereby produce a label.

Figure 1:
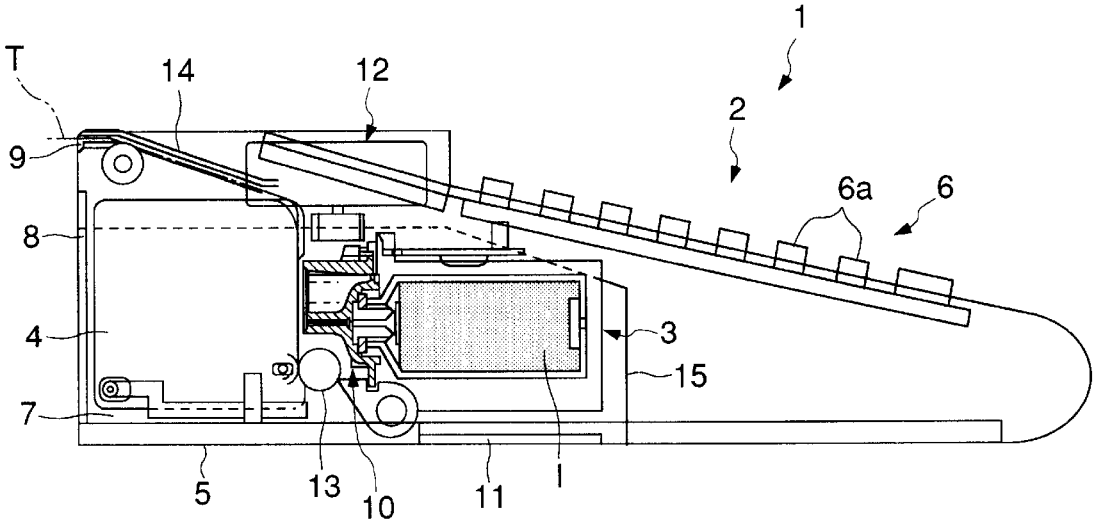
FIG. 1 is a cross-sectional view of a tape printing apparatus to which a print head device and an ink jet printer according a first embodiment of the invention are applied.

Referring first to FIG. 1, there is shown the tape printing apparatus having the ink cartridge and a tape cartridge loaded therein. As shown in the figure, the tape printing apparatus 1 is comprised of the ink cartridge 3 filled with a plurality of colors of ink, the tape cartridge 4 containing a tape, and an apparatus body 2 in which the ink cartridge 3 and the tape cartridge 4 are removably loaded. The apparatus body 2 has an apparatus casing 5 having a keyboard 6, which is comprised of various kinds of keys 6*a*, etc., arranged on a front portion thereof, and a liquid crystal display, not shown, arranged on a rear portion thereof.

In a rear wall of the apparatus casing 5, there is formed a first lid 8 in a manner facing a tape cartridge compartment 7 for loading i.e. mounting the tape cartridge 4 therein. The first lid 8 can be opened and closed for loading or removing the tape cartridge 4. Further, the rear wall of the apparatus casing 5 has a tape exit 9 in the form of a slit formed at a location above the first lid 8, for discharging a printed portion of the tape out of the apparatus casing 5. A second lid 11 which can be opened and closed for loading and unloading the ink cartridge 3 is formed in a bottom wall of the apparatus casing 5 at a location opposed to a print head unit 10, described hereinafter.

Within the apparatus casing 5, there is arranged an information processing section (not shown) in a front region. The print head unit 10 on which the tape cartridge 4 is mounted and a head-driving block 12 for causing the print head unit 10 to move (scan) during printing are arranged in a central region within the apparatus casing 5, and a tape feeding block 13 for feeding the tape from the tape cartridge 4, a tape-discharging block 14 for discharging a printed portion of the tape, etc. are arranged in a rear region within the same. The print head unit 10, the head-driving block 12, and the tape feeding block 13 are supported on a base frame 15 and incorporated in the apparatus body 2 in the unitized state.

After an image to be printed is finally determined on the liquid crystal display by operating a proper one of the keys 6*a*, if a print command is issued, the tape feeding block 13 operates to roll out the tape from the tape cartridge 4. After having been rolled out from the tape cartridge 4, the tape passes in front of the print head unit 10. Then, the tape is cut by the tape-discharging block 14 as required, followed by being discharged from the apparatus casing 5. In accordance with the running of the tape in front of the print head unit 10, the print head unit 10 is driven by the head-driving block 12 to perform lateral reciprocating motion repeatedly while jetting inks supplied from the ink cartridge 3, to thereby carry out printing on the tape. More specifically, the desired image is printed on the tape with the direction of reciprocation of the print head unit 10 set as a main scanning direction and the direction of feed of the tape set as a sub scanning direction.

Figure 2:
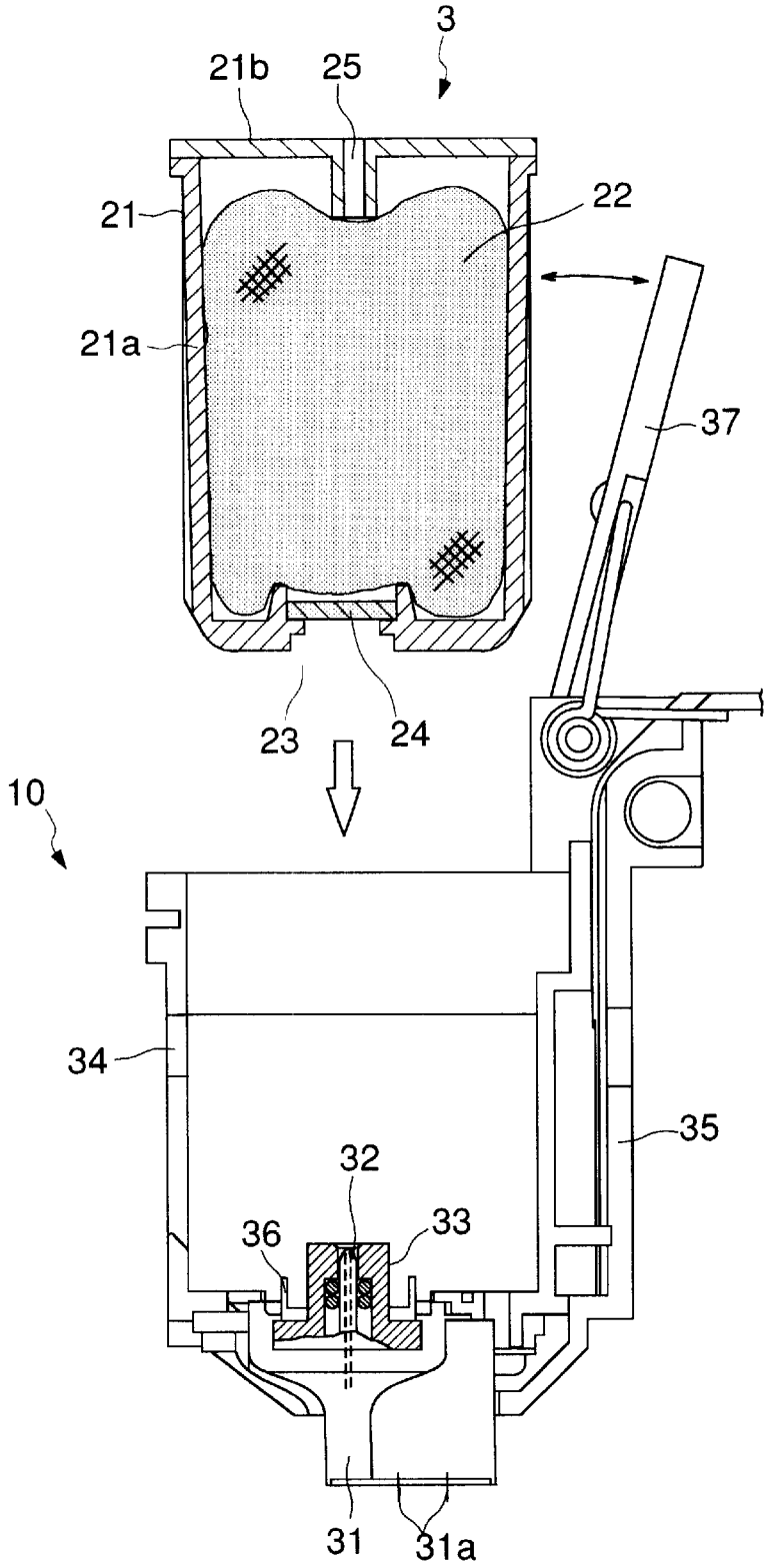
FIG. 2 is a cross-sectional view of a print head unit and an ink cartridge to be mounted in the print head unit, according to the first embodiment of the invention, both appearing in FIG. 1.

Next, description will be made of the print head unit 10 and the ink cartridge 3 with reference to FIG. 2. As shown in the figure, the ink cartridge 3 has a cartridge casing 21 comprised of a lower casing 21*a*, and an upper casing 21*b* arranged in a manner closing an upper end opening of the lower casing 21*a*. The cartridge casing 21 includes so-called ink tanks, each of which is filled with an ink absorbent 22 for absorbing ink therein for storage. There are four ink tanks arranged side by side for holding cyan ink, magenta ink, yellow ink, and black ink, respectively (see FIG. 4).

The lower casing 21*a* has a bottom formed with four ink delivery ports 23 for delivering the respective four colors of ink therefrom. The ink cartridge 3 is connected to the print head unit 10 (removably mounted in the same) via the ink delivery ports 23 in surface-to-surface contact. The ink delivery ports 23 each have a filter 24 arranged therein at a location downstream of the ink absorbent 22 and opposed to an opening of the port 23. The ink stored in the ink absorbent 22 is supplied to the print head unit 10 through the filter 24. Further, the upper casing 21*b* has a central portion thereof formed with four ink-charging ports 25 in a manner corresponding to the respective ink delivery ports 23. The ink-charging ports 25 are each communicated with the atmosphere via four meandering air communication passages, not shown, formed in the top surface of the upper casing 21*b*. Each ink held in the ink cartridge 3 is fed to the print head unit 10, while air is supplied to the ink cartridge 3 via the meandering air communication passages in an amount corresponding to an amount of ink delivered from the ink delivery port 23.

The print head unit 10 is comprised of a print head 31 having a large number of nozzles 31*a* arranged on one end thereof in a state aligned with each other, head needles 32 mounted in the print head 31, connecting caps 33 mounted on the respective head needles 32 in a manner covering the same, and a cartridge holder 43 in the form of a case. The print head unit 10 is installed on a carriage 44 connected to the head-driving block 12. Each connecting cap 33 has a sealing packing 36 fitted thereon such that the sealing packing 36 surrounds a protruding portion of the connecting cap 33. When the ink cartridge 3 is mounted in the print head unit 10, the sealing packing 36 is brought into contact with a rim of the ink delivery port 23, and at the same time the connecting cap 33 abuts the filter 24 in a manner pushing the same upward (see FIG. 3). It should be noted that reference numeral 37 in FIG. 2 indicated an urging lid for urging the ink cartridge inserted in the cartridge holder 3 toward the print head 31.

Figure 3:
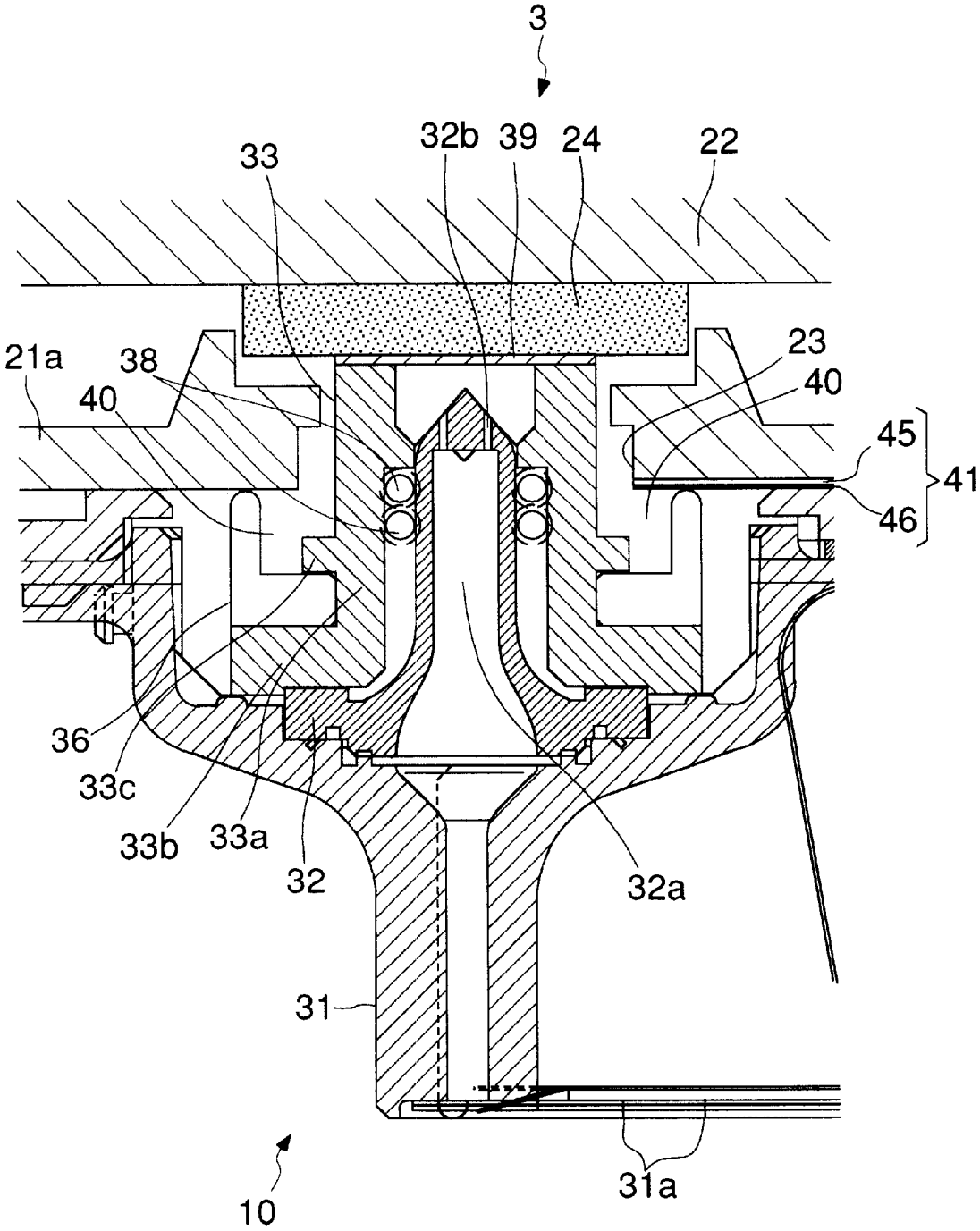
FIG. 3 is an enlarged partial cross-sectional view of the ink cartridge mounted in the print head unit.

As shown on enlarged scale in FIG. 3, the head needle 32 having a steeple-like needlepoint and a flanged root end is formed therethrough with an ink supply passage 32*a* communicating with the nozzles 31*a* on the print head 31. The tip of the head needle 32 is formed with a plurality of small holes 32*b*, via which the inside of the ink cartridge 3 and the ink supply passage 32*a* are in communication with each other. Further, each of the head needles 32 has two O rings 38, 38 fitted on a peripheral surface thereof to thereby provide a seal between the head needle 32 and the connecting cap 33.

The connecting caps 33 are each comprised of a cap body 33*a* formed to have a generally hollow cylindrical shape, a flange portion 33*b* continuous with a lower end of the cap body 33*a*, and an annular projection 33*c* protruding from an outer peripheral surface of the cap body 33*a*, all of which are integrally formed as a unitary member. Between the flange portion 33*b* and the annular projection 33*c* is fitted the above-mentioned seal packing 36. Further, reference numeral 39 in the figure designates a print head unit-side filter attached to the end of the connecting cap 33.

Each seal packing 36 is formed of silicone rubber or the like such that it has an annular shape and at the same time its wall has an L-shaped cross-section. The seal packing 36 has a lower end thereof in airtight contact with the flange portion 33*b* of the connecting cap 33 in a manner such that the lower end is seated or rests on the flange portion 33*b*. The upper end of the seal packing 36 is in airtight contact with the peripheral portion or rim of a corresponding one of the ink delivery ports 23 in the ink cartridge 3. A sealed space 40 communicating with the inside of the ink cartridge 3 is thus formed inside the seal packing 36. On the other hand, space outside the seal packing 36 is open to the atmosphere.

Figure 4:
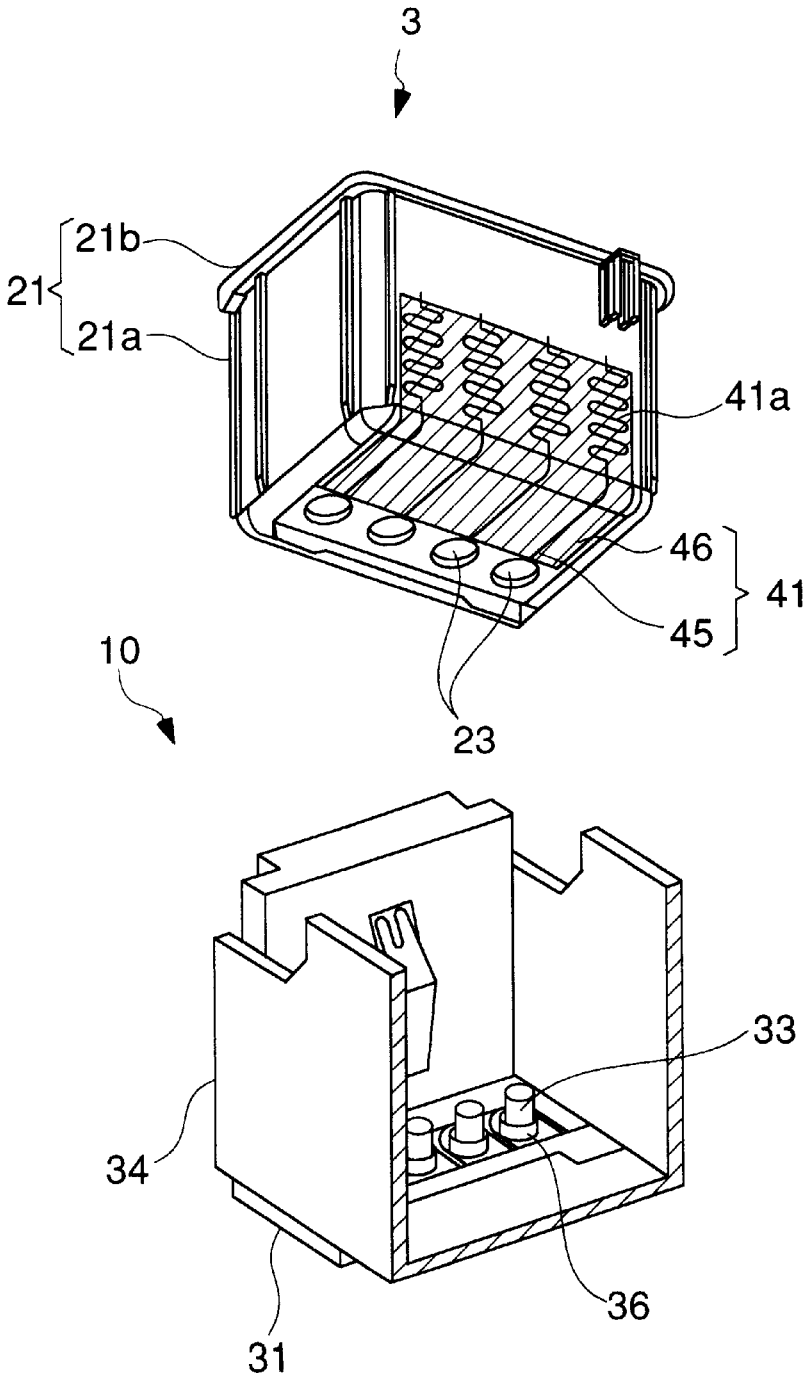
FIG. 4 is an exploded perspective view of the ink cartridge and the print head unit.

Next, the essential elements of the present embodiment will be described with reference to FIGS. 3 and 4. As described above, the sealed space 40 is formed inside the seal packing 36. When a force is applied to the seal packing 36 by a shock or the like, the seal packing 36 is expanded and contracted, thereby fluctuating pressure in the sealed space 40. There is a fear that these pressure fluctuations propagate to ink within the ink cartridge 3 communicating with the sealed space 40 to finally cause destruction of an ink meniscus at the tip of the nozzle 31*a*. To eliminate the possibility of this inconvenience, in the present embodiment, the ink cartridge 3 is formed with four air communication passages 41 for permitting communication between the inside and outside of each seal packing 36, so as to permit changed or fluctuated pressure within the sealed space 40 to escape.

The air communication passages 41 are each comprised of a groove 45 having a rectangular shape in cross-section and formed in a surface of the lower casing 21*a*, and a film 46 sealing the groove 45 by thermocompression bonding or the like. The air communication passage 41 extends from the rim of each ink delivery port 23 across a bottom surface of the lower casing 21*a* to an intermediate portion of a side surface of the lower casing 21*a*. The seal packing 36 abuts one end of the air communication passage 41, which is connected to the ink delivery port 23, and the film 46 terminates inward of a location where the seal packing 36 abuts the air communication passage 41, whereby the air communication passage 41 is communicated with i.e. open to the sealed space 40. At the other end of the air communication passage 41, the length of the groove 45 is slightly larger than that of the film 46 for causing the air communication passage 41 to communicate with i.e. to be open to the atmosphere.

Figure 5:
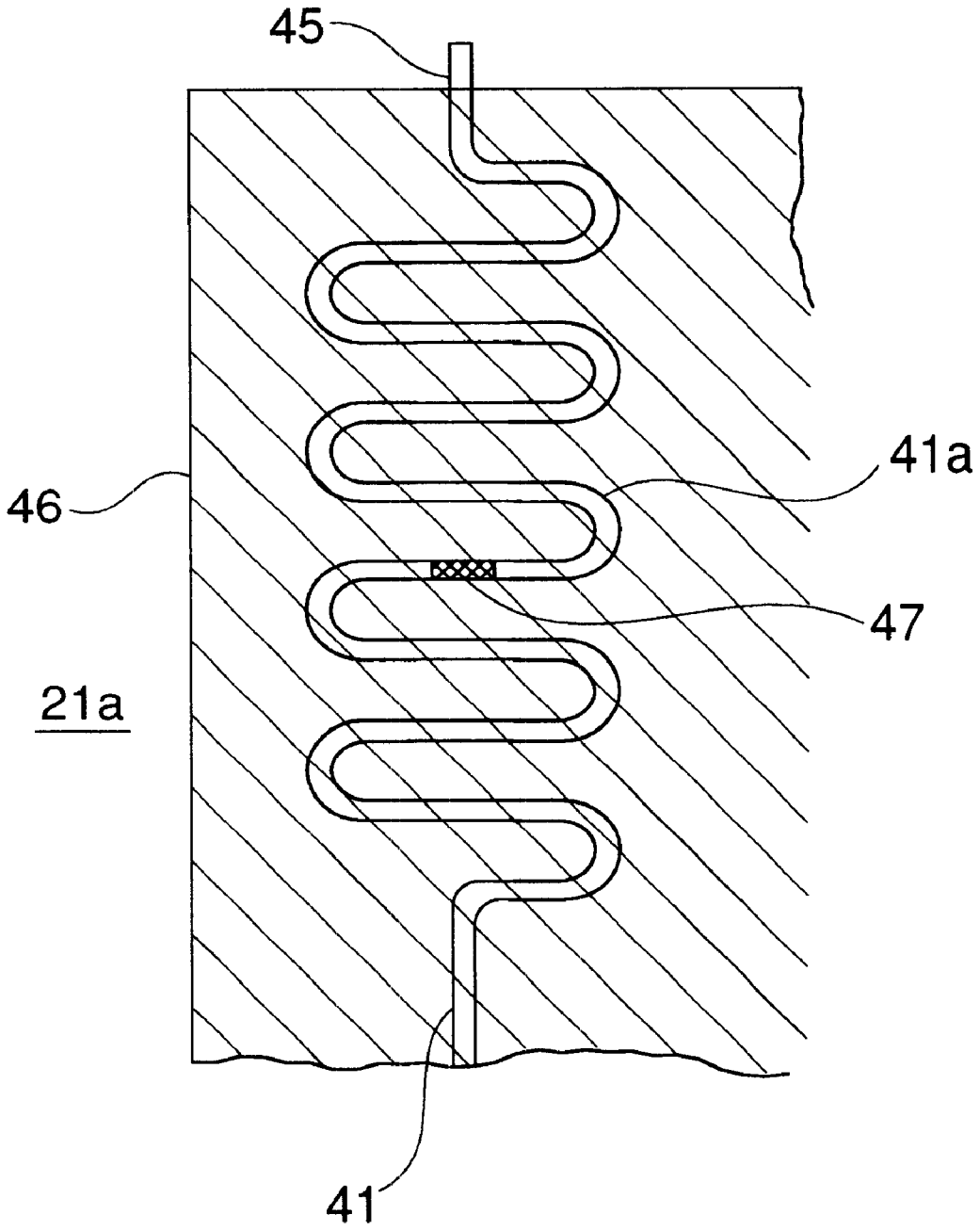
FIG. 5 is an enlarged plan view of a meandering portion of an air communication passage.

Each air communication passage 41 extends rectilinearly in the bottom surface of the lower casing 21*a*, whereas in the side surface thereof, the same extends in a meandering manner, forming a meandering portion 41*a*, as shown in FIG. 5. This enables the air communication passage 41 to be of sufficient length to inhibit evaporation of solvent contained in ink. Further, as shown in the figure, it is preferable to enclose a sealing liquid 47 comprised of a non-volatile oil in a portion of the meandering portion 41*a* of the air communication passage 41. The sealing liquid 47 blocks off the air communication passage 41 to separate air in the sealed space 40 from air in the atmosphere, while freely moving in the air communication passage 41 in accordance with pressure fluctuations within the sealed space 40. This positively prevents evaporation of a solvent contained in ink.

It should be noted that when the ink cartridge 3 is shipped or before it is used, the ink delivery ports 23 are sealed by an ink delivery port-sealing film, not shown, affixed thereto by thermocompression bonding. The ink delivery port-sealing film and the above air communication passages-sealing film 46 may be formed as separate members, or they may be formed as a unitary member provided that they are formed with cutting lines for permitting them to be separated from each other.

Figure 6:
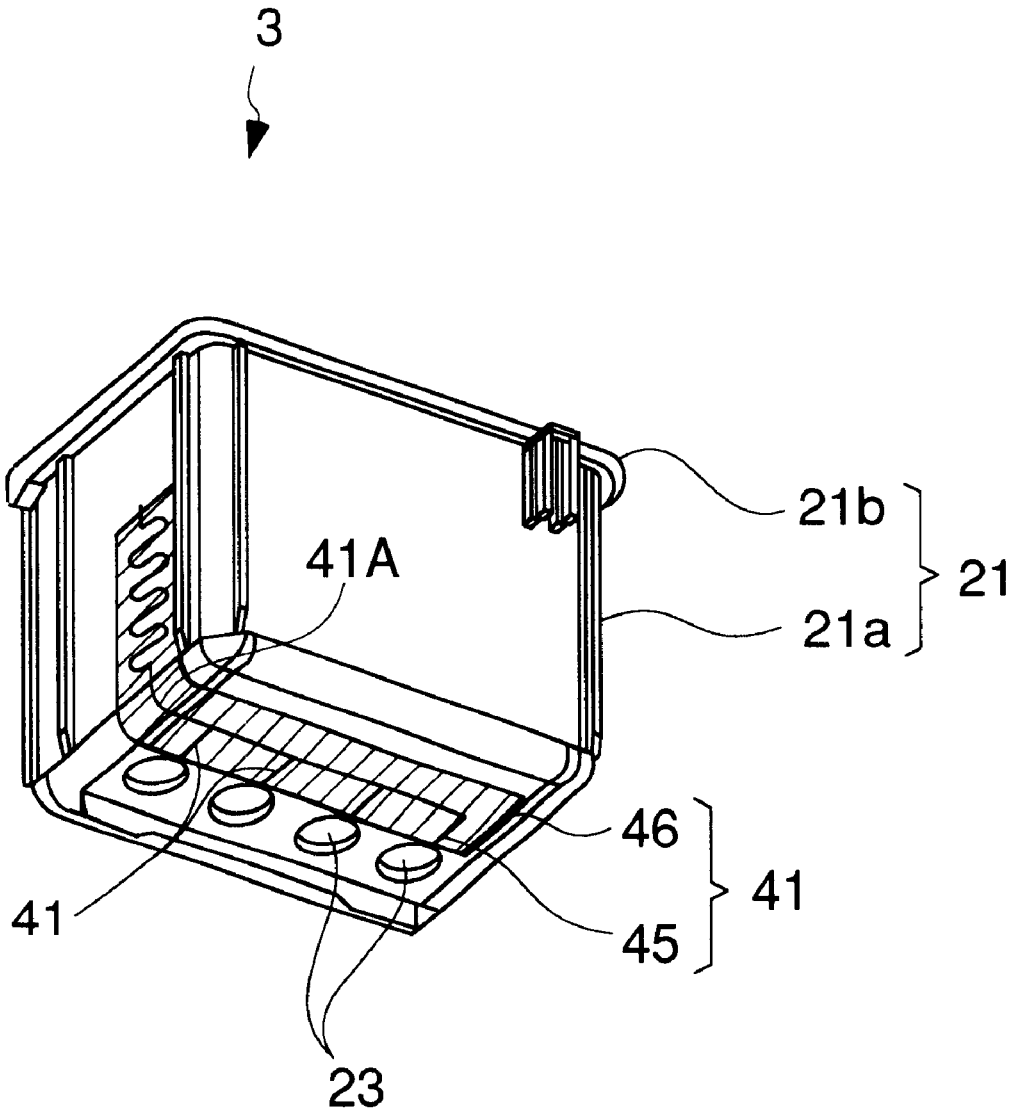
FIG. 6 is a perspective view of an ink cartridge including air communication passages formed therein, according to a second embodiment of the invention.

FIG. 6 shows air communication passages according to a second embodiment of the invention. In this embodiment, the four air communication passages 41 extending from respective ink delivery ports 23 are caused to meet to form a confluent portion 41A in the bottom surface of a lower casing 21*a*. The confluent portion 41A extends from the bottom surface of the lower casing 21*a* to an intermediate portion of a side surface on a shorter side of the lower casing 21*a*. The confluent portion 41A extends in a manner meandering in the side surface of the lower casing 21*a*. In this embodiment, from the viewpoint of frictional resistance, it is preferred that the confluent portion 41A has a larger cross-sectional area than that of each of the four air communication passages 41. Of course, the air communication passages 41 may be joined by twos to form two confluent portions.

Figure 7:
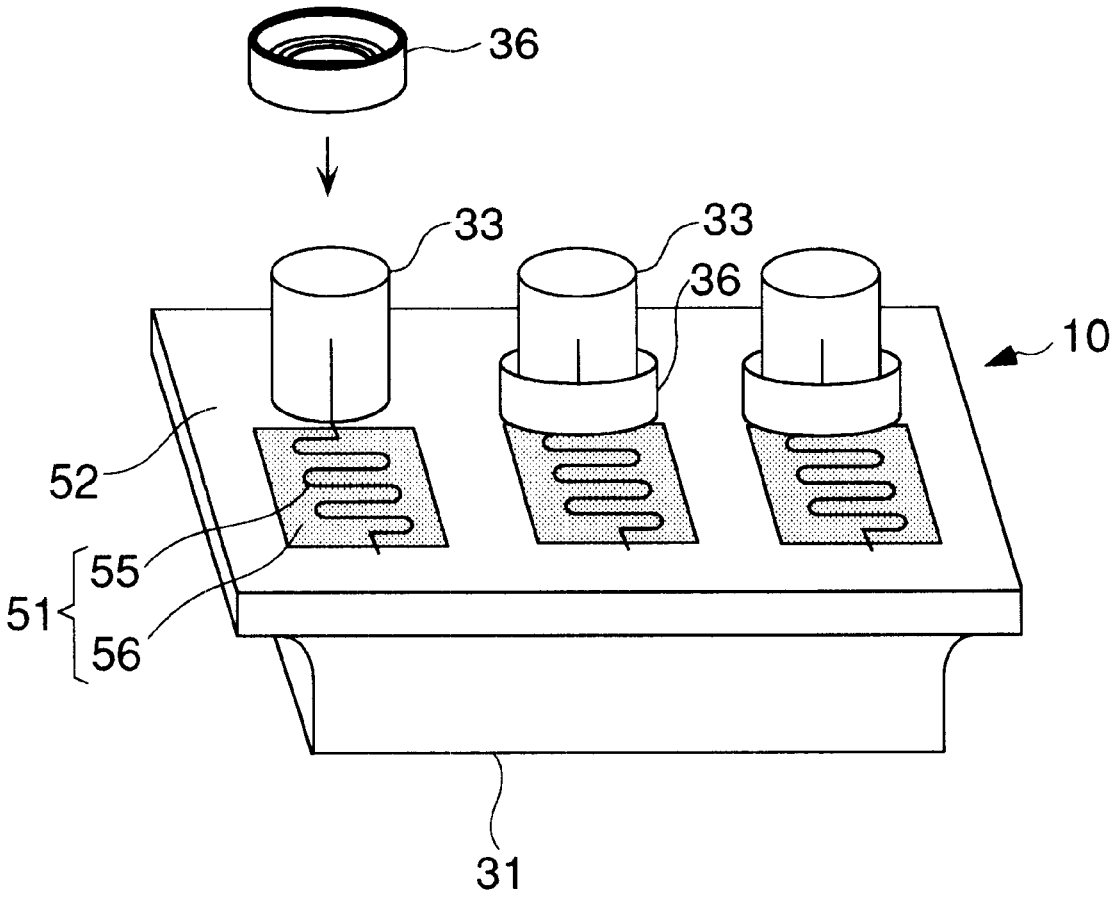
FIG. 7 is a perspective view of a print head unit including air communication passages formed therein, according to a third embodiment of the invention.

Next, a third embodiment of the invention in which air communication passages are formed in a print head unit will be described with reference to FIG. 7. The print head unit 10 is for use in combination with an ink cartridge filled with three colors of ink, and has a print head 31 and connecting caps 33 integrally formed with the print head 31. Similarly to the above embodiments, each air communication passage 51 is comprised of a groove 55 formed in a surface of a cartridge-receiving portion 52 of the print head 31 and a film 56 covering the groove 55. The air communication passage 51 has one end thereof extending to one of the connecting caps 33 to permit the same to communicate with a sealed space 40, and the other end thereof extending to a peripheral portion of the cartridge-receiving portion 52 to permit the same to communicate with the atmosphere. Further, the air communication passage 51 has an intermediate portion thereof extending in a manner meandering in the cartridge-receiving portion 52.

As described above, according to the above embodiments, even when the seal packing 36 is expanded and contracted (compressed) by a shock or the like to thereby cause pressure fluctuations within the sealed space 40, the increased or decreased pressure is released through the air communication passages 41 or 51, so that the pressure fluctuations generated within the sealed space 40 are accommodated by the atmosphere. Hence, the pressure fluctuations within the sealed space 40 can be prevented from propagating to ink in the print head 31 via the ink cartridge 3, thereby preventing the shock or impact from destroying the ink meniscus at the tip of the nozzle 31*a*. This makes it possible to markedly enhance shock resistance of the tape printing apparatus 1.

Figure 8:
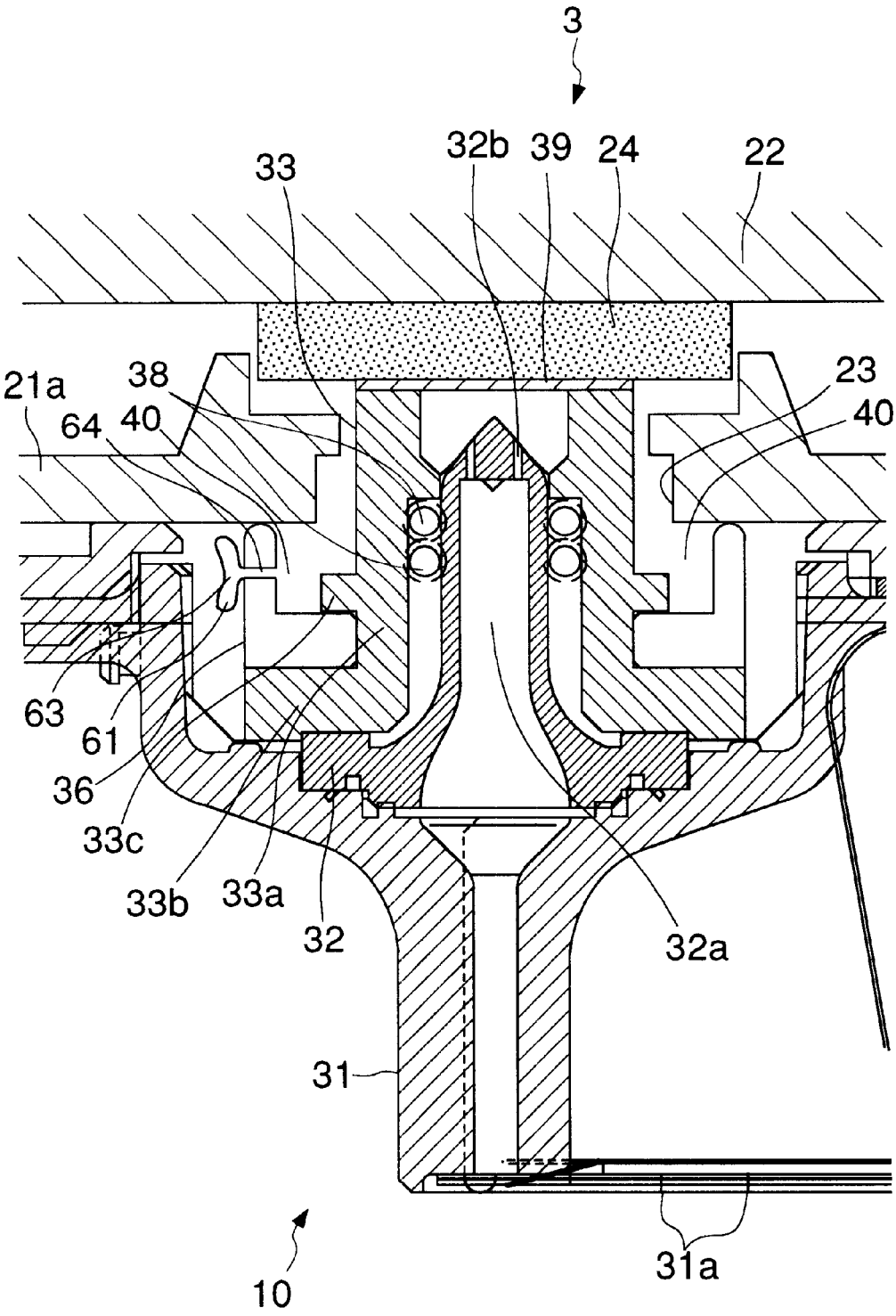
FIG. 8 is an enlarged partial cross-sectional view of a print head unit with an ink cartridge mounted therein, according to a fourth embodiment of the invention.

Next, a fourth embodiment of the invention will be described with reference to FIG. 8. In this embodiment, in place of the above air communication passages 41 or 51, a damper 61 is provided for the seal packing 36, for absorbing pressure fluctuations generated within the sealed space 40. The damper 61 is comprised of a damper body (pouch) 63 which is formed of a flexible and pouched membrane, and a tube 64 integrally formed with the damper body 63 and extending from the same. The damper body 63 is arranged outside the seal packing 36, and the tube 64 extends through the wall of the seal packing 36 such that its open end opens into the sealed space 40.

According to the above construction, even when the seal packing 36 is expanded and contracted (compressed) due to a shock to thereby cause pressure fluctuations within the sealed space 40, the pressure fluctuations are accommodated by the inner space of the damper body 63, so that it is possible to prevent the shock from destroying the ink meniscus at the tip of the nozzle 31*a*.

Figure 9:
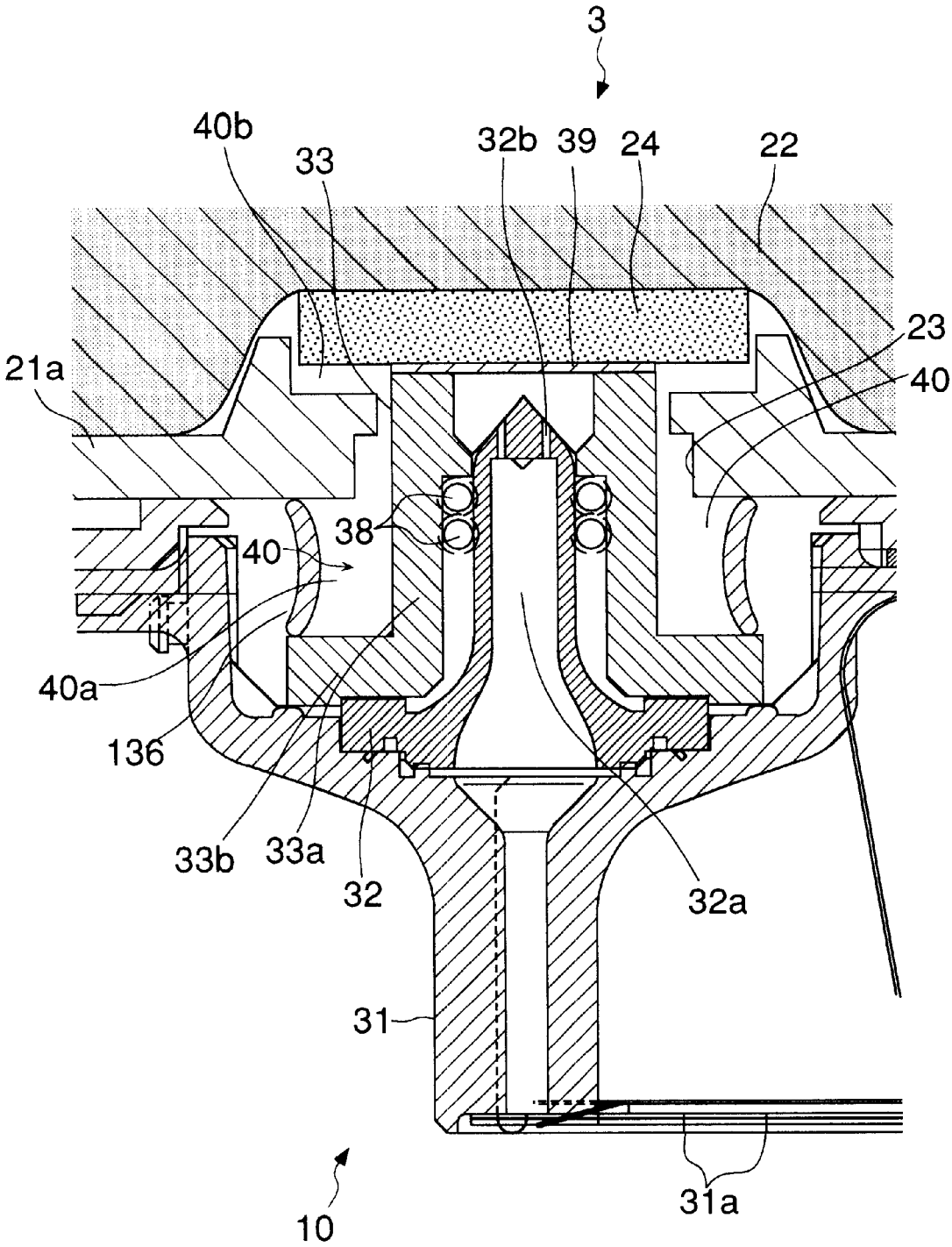
FIG. 9 is an enlarged partial cross-sectional view of a print head unit with an ink cartridge mounted therein, according to a fifth embodiment of the invention.

Next, a fifth embodiment of the invention will be described with reference to FIGS. 9 to 11B. As shown in FIG. 9, in the fifth embodiment, each connecting cap 33 is comprised of a cap body 33*a* having a generally hollow cylindrical shape, and a flange portion 33*b* integrally formed with the cap body 33*a* in a manner continuous with a lower end of the cap body 33*a*. The seal packing 136 is seated or rests on an outer end of the flange portion 33*b*. Further, reference numeral 39 designates a print head unit-side filter attached to the end of the connecting cap 33.

The seal packing 136 is formed of silicone rubber or the like and has a wall forming a generally hollow cylindrical shape and at the same time constructed such that the wall has an inwardly curved arcuate cross-section. The inner diameter of the seal packing 136 is approximately equal to the outer diameter of the filter 24, preferably slightly larger than the outer diameter of the filter 24. The seal packing 136 has a lower end thereof seated or resting on the flange portion 33*b* of the connecting cap 33 in airtight contact therewith. The upper end of the seal packing 136 is in airtight contact with the peripheral portion or rim of one of the ink delivery ports 23 in the ink cartridge 3. A sealed space 40 communicating with the inside of the ink cartridge 3 is thus formed inside the seal packing 136. More specifically, the sealed space 40 is formed of an inner space 40*a* inside the seal packing 136 defined between the seal packing 136 and the connecting cap 33, and an empty space 40*b* of a filter-holding block 26 defined between the filter 24 and the lower casing 21*a*. The inner space 40*a* and the empty space 40*b* communicate with each other via the ink delivery port 23. Further, an open space outside the seal packing 136 communicates with the atmosphere.

Figures 10A, 10B:
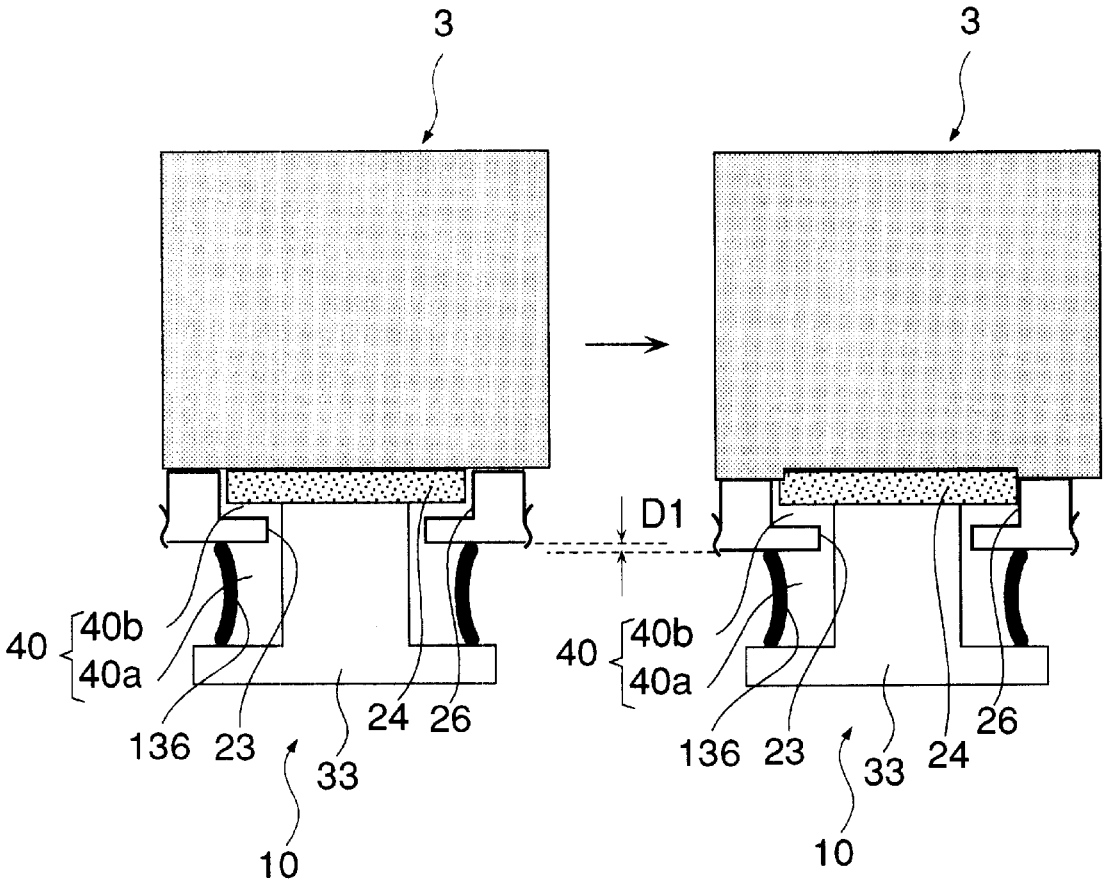
FIGS. 10A and 10B are schematic cross-sectional views of the FIG. 9 print head unit and ink cartridge, which are useful in describing a state in which the print head unit has received a shock to have a seal packing thereof contracted.

Next, an operation of the print head device according to the present embodiment in the case where a shock or impact is applied to the tape printing apparatus 1 to relatively move the ink cartridge 3 toward and away from the print head unit 10 by inertia will be described with reference to FIGS. 10A to 11B. FIG. 10A schematically shows the ink cartridge 3 in a normal state thereof. FIG. 10B schematically shows the ink cartridge 3 in a state in which it is moved toward the print head unit 10 by the distance of D1 from the FIG. 10A state. In this case, the connecting cap 33 of the print head unit 10 relatively pushes the filter 24 into the ink cartridge 3 by the distance of D1, while the seal packing 136 is contracted by the distance of D1.

When the connecting cap 33 pushes the filter 24 into the ink cartridge 3, the empty space 40*b* of the filter-holding block 26 is expanded by the volume of the distance D1×an area of the bottom area of the filter 24 minus the top area of the connecting cap 33 (print head unit-side filter 39). On the other hand, when the seal packing 136 is contracted, it is largely bent inward, and the inner space 40*a* inside the seal packing 136 is reduced by the volume of the distance D1×the area of the bottom area of the seal packing 136 minus the top area of the connecting cap 33 (print head unit-side filter 39) plus the volume reduced by bending of the seal packing 136. Therefore, a negative pressure is generated in the empty space 40*b*, while a positive pressure is generated in the inner space 40*a*, so that air flows from the inner space 40*a* to the empty space 40*b* via the ink delivery port 23. In this process, a decrease in the volume of the inner space 40*a* is substantially equal to an increase in the volume of the empty space 40*b*, and hence the changes in pressure (positive and negative pressures) are accommodated by the air flow occurring within the sealed space 40 such that the negative and positive pressures cancel each other.

Figures 11A, 11B:
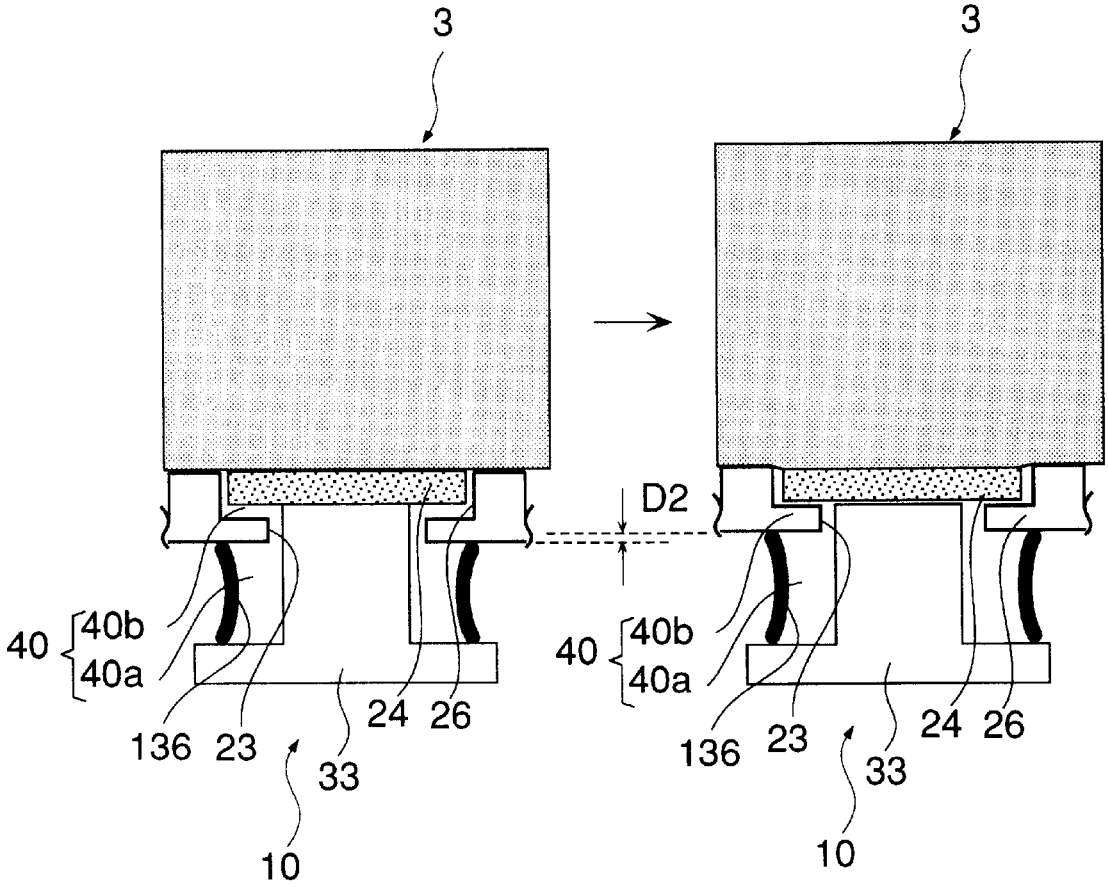
FIGS. 11A and 11B are schematic cross-sectional views of the FIG. 9 print head unit and ink cartridge, which are useful in describing a state in which the print head unit has received a shock to have the seal packing thereof extended.

Similarly, FIG. 11B schematically shows the ink cartridge 3 in a state in which it is moved away from the print head unit 10 by the distance of D2 from the FIG. 11A normal state. In this case, the filter 24 relatively pushes out the connecting cap 33 by the distance of D2, and at the same time the seal packing 136 is caused to extend by the distance D2. Therefore, inversely to the above case, a positive pressure is generated in the empty space 40*b* and a negative pressure is generated in the inner space 40*a*, so that air flows from the empty space 40*b* to the inner space 40*a*, whereby changes in pressure (positive and negative pressures) are accommodated within the sealed space 40 in a manner such that the negative and positive pressures cancel each other.

For this reason, even if a shock or impact is applied to the tape printing apparatus 1, the pressure in the sealed space 40 is prevented from changing. That is, changes in pressure generated in the empty space 40*b* and the inner space 40*a* do not propagate to ink in the print head 31 via the ink cartridge 3, thereby preventing the shock or impact from destroying the ink meniscus at the tip of the nozzle 31*a*. Accordingly, it is possible to markedly enhance shock resistance of the tape printing apparatus 1. It should be noted that the seal packing 136 is not necessarily required to be curved in its free state. For instance, the seal packing 136 may be formed such that only a core material thereof is curved, and the seal packing 136 is bent inwardly upon receipt of an external force.

Next, a sixth embodiment of the invention will be described with reference to FIGS. 12A to 12C. In this embodiment, each ink delivery port has a rim thereof formed with first and second air passages 51, 52 which permit communication between the empty space 40*b* of the filter-holding block 26 and an outer space 42 of the seal packing 136. The first air passage 51 is provided with a first valve element 53 on an outer space-side surface of the rim of the ink delivery port 23, and the second air passage 52 is provided with a second valve element 54 on an empty space-side surface of the rim of the ink delivery port 23.

In this embodiment, differently from the fifth embodiment, when a positive pressure is generated in the sealed space 40 by a shock, the first valve element 53 is opened outward with the second valve element 54 remaining in the closed state to discharge air in the empty space 40*b* into the outer space 42 via the first air passage 51 (see FIG. 12B). Inversely, when a negative pressure is generated in the sealed space 40, the second valve element 54 is opened inward with the first valve element 53 remaining in the closed state to introduce air from the outer space 42 into the empty space 40*b* via the second air passage 52 (see FIG. 12C).

As a result, even when pressure in the sealed space 40 is changed or fluctuated by a shock or the like, changes in pressure or pressure fluctuations are accommodated by the atmosphere in communication with the sealed space 40 via the first and second air passages 51, 52 opened and closed by the first and second valve elements 53, 54, respectively. That is, the pressure fluctuations within the sealed space 40 can be controlled and prevented from propagating to ink in the print head 31 via the ink cartridge 3, thereby preventing the shock or impact from destroying the ink meniscus at the tip of the nozzle 31*a*. Therefore, it is possible to markedly enhance shock resistance of the tape printing apparatus 1.

Although in the above embodiments, description has been made of the cases in which the present invention is applied to the tape printing apparatus, this is not limitative, but it goes without saying that the above-described construction of each embodiment can be applied to ink jet printers of the general type.

Further, in the first to fourth embodiments, each air communication passage may be formed by a member in the form of a pipe which extends through the seal packing, the cartridge casing or the connecting cap. Although in the sixth embodiment, valve means comprised of the first valve element and the second element has been described, this is not limitative, but in place of them, a single valve member may be employed which can be opened inward and outward.

Further, according to the ink jet printer of the invention, the print head device can be made shock-resistant, so that it is possible to construct a portable printer or a printer of a type which can be moved frequently without the problem of destruction of an ink meniscus.

It is further understood by those skilled in the art that the foregoing is preferred embodiments of the invention, and that various changes and modifications may be made without departing from the spirit and scope thereof.

What is claimed is:

1. A printing device comprising:

a print head device;

and an ink cartridge;

the ink cartridge storing ink therein, and being removably mounted in the print head device for use therewith, said print head device having a seal packing arranged such that said seal packing is brought into airtight contact with said ink cartridge to define an inner space within said seal packing when said ink cartridge is mounted in said print head device, the seal packing being expanded and contracted or compressed in response to shocks or impacts to the print head device, the ink cartridge comprising:

a cartridge casing for being brought into airtight contact with said seal packing;

an ink delivery port formed through said cartridge casing, for delivering said ink therefrom, said ink delivery port being arranged such that said ink delivery port establishes airtight communication with said inner space defined within said seal packing when said ink cartridge is mounted in said print head device; and pressure fluctuation-accommodating means for accommodating pressure fluctuations within said ink delivery port and said inner space in communication with each other, the pressure fluctuation-accommodating means being in communication with atmosphere, the pressure fluctuations being caused by expansion and contraction or compression of the seal packing in response to shocks or impacts to the print head device, wherein said pressure fluctuation-accommodating means comprises an air communication passage formed in a surface of said cartridge casing, said air communication passage having one end open to said inner space within said seal packing and another end open to atmosphere.

2. A printing device according to claim 1, wherein said air communication passage comprises a groove formed in said surface of said cartridge casing, and a film hermetically covering said groove except for opposite ends thereof.

3. A printing device according to claim 1, wherein said air communication passage extends in a meandering manner.

4. A printing device according to claim 1, wherein a drop of non-volatile sealing liquid is sealingly held in said air communication passage, for motion in accordance with air flows in said air communication passage.

* * * * *